United States Patent [19]

Tanaka et al.

[11] Patent Number: 4,988,746

[45] Date of Patent: Jan. 29, 1991

[54] FLAME RESISTANT STAPLE FIBER BLEND

[75] Inventors: Makoto Tanaka, Toyonaka; Mutsuo Katsu, Iwakuni; Tadashi Seki, Osaka, all of Japan

[73] Assignee: Teijin Limited, Osaka, Japan

[21] Appl. No.: 314,384

[22] Filed: Feb. 23, 1989

[30] Foreign Application Priority Data

Feb. 26, 1988 [JP] Japan ..... 63-42300

[51] Int. Cl.[5] ..... C08J 5/00; C08L 77/00

[52] U.S. Cl. ..... 524/12; 525/432

[58] Field of Search ..... 525/432; 524/12

[56] References Cited

U.S. PATENT DOCUMENTS 4,120,914 10/1978 Behnke et al. ..... 525/432

4,278,779 7/1981 Nakagawa et al. ..... 525/432

FOREIGN PATENT DOCUMENTS 051055 3/1986 Japan ..... 525/432

*Primary Examiner*—Lewis T. Jacobs

*Assistant Examiner*—Vasu S. Jagannathan

*Attorney, Agent, or Firm*—Burgess, Ryan & Wayne

[57] ABSTRACT

A flame resistant staple fiber blend, useful for flame-resistant clothing, comprising 80 to 97 weight parts of m-aramide polymer staple fibers (A) with a small thermal shrinkage stress of 130 mg/d or less at 350° C., 3 to 20 weight parts of p-aramide copolymer staple fibers (B) with a higher flame resistance than that of the m-aramide fiber (A), and optionally, 240 weight parts or less of non-fusible staple fibers (C) with a lower thermal shrinkage stress than that of the staple fiber (A).

5 Claims, No Drawings

FLAME RESISTANT STAPLE FIBER BLEND

BACKGROUND OF THE INVENTION

1. Field of the Invention

The present invention relates to a flame resistant staple fiber blend. More particularly, the present invention relates to a flame resistant staple fiber blend useful for flame-resistant clothing, etc., for people who may be exposed to flame, for example, firemen, airmen, racing car drivers, and operators of electric power factories and chemical factories.

2. Description of the Related Arts

It is known that flame-retarded cotton, wool fibers and flame retardant polyvinyl alcohol fibers and rayon fibers are resistant to flame and are non-heat fusible, and thus are useful for making flame-resistant clothing.

Some of the above-mentioned fibers, however, are disadvantageous in that they do not have a satisfactory flame-resistance when used as flame-resistant clothing, or heat resistance after a prolonged exposure to a high temperature of 200° C. or more.

It is also known that carbonized rayon fibers and polybenzimidazol fibers have an excellent heat and flame-resistance and are useful for heat and flameresistant clothing. These fibers, however, are disadvantageous in that the dyeability thereof is poor, and thus such fibers are not satisfactory when used for clothing. Also, they do not have a satisfactory touch and mechanical strength.

Accordingly, currently, poly(m-phenylene isophthalamide) fibers, which exhibit a satisfactory heat and flame resistance and mechanical strength and can be dyed any color, are widely used for flameresistant clothing. The m-aramide polymer fibers, however, are disadvantageous in that when exposed to flame, the m-aramide polymer fiber clothing is easily thermally shrunk, perforated, and broken.

To overcome the above-mentioned disadvantages of the m-aramide polymer fibers, Japanese Unexamined Patent Publication (Kokai) No. 49-110,921 discloses a flame-resistant fiber article comprising 20 to 90% by weight of wholly aromatic polyamide fibers and 10 to 80% by weight of flame-retardant fibers which are carbonized while maintaining the form of fibers thereof when exposed to flame.

The wholly aromatic polyamide fibers are the same as the m-aramide polymer fibers.

The heat and flame resistance of the frameresistant fiber article disclosed by the Japanese Kokai '921 is still not satisfactory in that, when exposed to flame, the fiber article cannot be maintained in the form of the article without perforation and breakage over a time necessary to be extricated from the flame. Namely, the conventional flame-resistant fiber article is not usable in a specific condition or atmosphere.

SUMMARY OF THE INVENTION

An object of the present invention is to provide a flame-resistant staple fiber blend which is useful for forming flame-resistant fiber clothing which can be maintained in an unchanged form and dimensions without perforation and breakage over a time necessary to be extricated from a flame.

The above-mentioned object can be attained by the flame resistant staple fiber blend of the present invention which comprises:

(A) 80 to 97 parts by weight of staple fibers comprising a m-aramide polymer material and having a thermal shrinkage stress of 130 mg/denier or less at a temperature of 350° C.; and (B) 3 to 20 parts by weight of staple fibers comprising a p-aramide copolymer material, having a higher flame resistance than that of the m-aramide staple fibers (A), and evenly blended with the m-aramide staple fiber (A).

Optionally, the flame-resistant staple fiber blend of the present invention further comprises (C) 240 parts by weight or less of additional staple fibers which are not fusible and have a lower thermal shrinkage stress than that of the m-aramide staple fibers (A), evenly blended with the staple fibers (A) and (B).

DESCRIPTION OF THE PREFERRED EMBODIMENTS

The flame resistant staple (short or cut) fiber blend of the present invention comprises 80 to 97 parts by weight of m-aramide polymer staple fibers (A) and 3 to 20 parts by weight of p-aramide copolymer staple fibers (B) evenly blended with the m-aramide polymer staple fibers A.

The m-aramide polymer staple fibers (A) have a thermal shrinkage stress of 130 mg/denier or less at a temperature of 350° C.

The thermal shrinkage stress generated in the fibers is determined in the following manner.

A fiber specimen having a denier of 50 to 200 is prepared from a bundle of a plurality of fibers arranged in parallel to each other and having a length of 200 mm.

An end of the specimen is fixed in a tester, and the other end of the specimen is subjected to a predetermined load. The ambient atmosphere in which the specimen is located is gradually heated to a temperature of 350° C. at a temperature-elevating rate of 10° C./min, and the length of the specimen is measured at a temperature of 350° C. A change in length of the specimen at 350° C. under the load is determined. The same measurement as mentioned above is repeated at least three times, and the load applied to the fiber specimen is changed at least three times.

The resultant data is plotted in rectangular coordinates in which the ordinate indicates the change (increase or decrease) in length of the specimen and the abscissa indicates the load applied to the specimen, to provide a curve showing a relationship between the load and the change in length of the specimen. The curve is extended until intersecting the abscissa. The point of intersection with the abscissa shows a load at which the change in length of the specimen is zero at a temperature of 350° C. The load corresponds to a thermal shrinkage stress of the specimen at the temperature of 350° C.

Then, the change in length of the specimen is actually measured under a load at 350° C., to check whether or not the determined load is correct. If correct, the thermal shrinkage stress of the specimen at 350° C. is taken to be the determined value of the load.

The m-aramide polymer staple fibers having a thermal shrinkage stress of 130 mg/denier or less at a temperature of 350° C. can be prepared by various methods. For example, the composition of the m-aramide polymer material is changed by blending at least one type of poly-m-phenylene isophthalamide copolymer with a poly-m-phenylene isophthamide homopolymer and the resultant composition-modified polymeric blend is converted to staple fibers. In another example, the thermal shrinking property of the m-aramide polymer staple fibers is changed by changing the fiber-producing conditions, for example, spinning speed, draw-ratio, heat-treated conditions, and relaxing treatment conditions.

The m-aramide polymers usable for the staple fibers (A) of the present invention include the polymeric blends of poly-m-phenylene isophthalamide homopolymer with at least one of the following aromatic polyamide polymers.

(a) Aromatic polyamide polymers comprising an acid component consisting of an aromatic dicarboxylic acid, for example, isophthalic acid or terephthalic acid and an amine component consisting of 35 to 100 molar% of xylene diamine and 0 to 65 molar% of an aromatic diamine different from the xylene diamine, for example, m-phenylene diamine or p-phenylene diamine, as disclosed, for example, in Japanese Unexamined Patent Publication No. 55—21406.

(b) Aromatic polyamide polymers comprising an acid component consisting of an aromatic dicarboxylic acid, for example, isophthalic acid or terephthalic acid, and an amine component consisting of 40 to 100 molar% of a substituted phenylene diamine having at least one substituent consisting of an alkyl radical with 1 to 4 carbon atoms and 0 to 60 molar% of an aromatic diamine different from the alkyl-substituted phenylene diamine, for example, m-phenylene diamine or p-phenylene diamine, as disclosed in Japanese Unexamined Patent Publication No. 55—21407.

(c) Aromatic polyamide polymers comprising an acid component consisting of an aromatic dicarboxylic acid, for example, isophthalic acid or tetraphthalic acid, and an amine component consisting of 40 to 100 molar% of a substituted phenylene diamine having 1 to 4 substituents each consisting of a halogen atom, for example, chlorine atom, and 0 to 60 molar% of an aromatic diamine different from the halogen-substituted phenylene diamine, for example, m-phenylene diamine or p-phenylene diamine, as disclosed in Japanese Unexamined Patent Publication No. 55—29516.

The m-aramide polymer material usable for the staple fibers (A) comprises 85 to 100 molar % of recurring units of the formula:

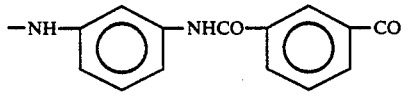

and preferably intrinsic viscosity of 0.8 to 4.0, determined in a solvent consisting of a concentrated sulfuric acid at a concentration of 0.5 g/100 ml, at a temperature of 30° C.

The m-aramide polymer staple fibers (A) can optionally contain at least one additive, for example, flame retarding agent, coloring agent, agent for enhancing a resistance to light, delustering agent, and electroconductive agent, unless it will affect the attainment of the object of the present invention.

The staple fibers (B) usable for the present invention comprises a p-aramide copolymer.

The p-aramide copolymer comprises at least one type or at least two types of recurring units of the formula; —NH—$Ar_1$—NJ—, and at least two types or at least one type of recurring units of the formula; —CO—$Ar_2$—CO—, wherein $Ar_1$ and $Ar_2$ represent, respectively and independently from each other, a member selected from the group consisting of:

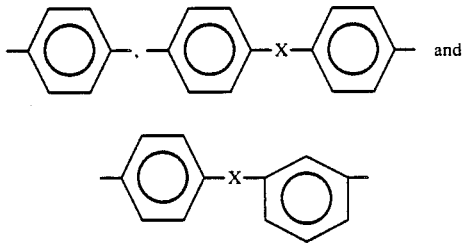

wherein X represents a member selected from the group consisting of

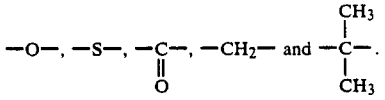

For example, the p-aramide copolymer is a copoly-p-phenylene/3,4'-oxydiphenylene terephthalamide.

The p-aramide copolymer staple fibers (B) must have a higher flame resistance than that of the m-aramide polymer staple fibers (A).

The flame-resistance of the fibers is determined in the following manner.

A band-shaped fabric specimen consisting of the staple fibers to be tested is placed horizontally in a tester, and a tension of 30 mg/denier is applied to the specimen. A flame at a temperature of 750° C. is applied to the lower surface of the specimen at a right angle to the horizontal specimen, and a time in seconds necessary to burn away the specimen with the flame is measured. The flame resistance of the specimen is represented by the time needed for the burning away.

Usually, the m-aramide polymer fibers (A) have a flame resistance of 4 seconds or less. The p-aramide copolymer fibers (B) usable for the present invention must exhibit a higher flame resistance than that of the m-aramide polymer fibers (A).

The p-aramide copolymer staple fibers (B), optionally contain at least one additive, for example, a flame-retarding agent, coloring agent, light resistance-enhancing agent, and delustering agent, in a predetermined amount, unless the object of the present invention will be affected thereby.

The m-aramide polymer staple fibers (A) and the p-aramide copolymer staple fibers (B) preferably have a length of from 25 to 200 mm, and are evenly blended by a conventional blending method, for example, air-blow blending method or simultaneous cutting and blending method.

When the fiber blend is used for spinning process, the staple fibers (A) and (B) preferably have a crimp number of 4 to 20 crimps/25.4 mm.

Due to the blend of the m-aramide polymer staple fibers (A) having a small thermal shrinkage with the p-aramide copolymer staple fibers B having a high flame resistance, the resultant fiber blend exhibits an improved resistance to flame perforation when a flame is brought into contact with an article comprising the fiber blend.

The flame perforation resistance of the fiber blend is determined in the following manner.

A fabric made of a staple fiber blend to be tested and having a length of 12 cm and a width of 12 cm is fixed on a square pin frame having a length of 10 cm, a width of 10 cm, and a thickness of 0.5 cm.

The frame with the fabric is horizontally placed on a tripod having a height of 22.5 cm.

A flame having a length of about 13 cm to 15 cm and a peak temperature of 1100° C. to 1200° C. is generated from a Bunsen burner having an inside diameter of 1.15 cm, an outside diameter of 1.6 cm, and a height of 16 cm. The flame is brought into a position immediately below the fabric, at which the distance between the top end of the Bunsen burner and the lower face of the fabric is 7 cm, to heat the fabric by the flame. A time necessary to perforate or crack the fabric after the flame is placed in the above-mentioned position is measured, and the flame perforation resistance of the fabric is represented by the measured time (in seconds).

The flame perforation time of the fabric corresponds to a time in which the fabric remains in the flame before perforation or burning away. The higher the flame perforation resistance, the longer the time in which the fabric remains unperforated or is not burned away.

In the staple fiber blend of the present invention, the blend ratio of the m-aramide polymer staple fibers (A) to the p-aramide copolymer staple fibers (B) must be from 80:20 to 97:3.

When the blend ratio is more than 97:3, the resultant fiber blend fabric exhibits a poor flame perforation resistance of 20 seconds or less.

If the blend ratio is less than 80:20, the resultant fiber blend fabric exhibits an excessive stiffness and an undesirable uneven gloss.

The staple fiber blend of the present invention optionally further comprises 240 parts by weight or less, preferably from 25 to 125 parts by weight, of additional staple fibers (C) which are not fusible, have a lower thermal shrinkage stress than that of the m-aramide polymer staple fibers (A), and are evenly blended with the staple fibers (A) and (B). The additional staple fibers (C) effectively enhance the clothing properties and flame resistance of the staple fiber blend of the present invention.

The additional staple fibers (C) are not fusible even when exposed to a flame, and have a lower thermal shrinkage stress than that of the staple fibers (A), and thus enhance the thermal shrinkage of the fiber blend.

The additional staple fibers (C) are preferably selected from flame-retarded cotton fibers, wool fibers, and flame-retardant rayon fibers.

Those non-fusible staple fibers have substantially no thermal shrinkage stress.

Usually, the non-fusible fibers having a lower thermal shrinkage stress than that of the m-aramide polymer fibers exhibit a poor heat resistance and are easily thermally decomposed at a temperature of 200° C. or more. Therefore, use of the non-fusible fibers per se cannot be prolonged at a high temperature of 200° C. or more.

Nevertheless, when the non-fusible additional staple fibers (C) is used as an even blend with the staple fibers (A) and (B) in specific proportion as mentioned above, the resultant fiber blend exhibits an excellent flame and heat resistance, at a high temperature, for a prolonged period.

The fiber articles prepared from the staple fiber blend of the present invention exhibit not only a satisfactory heat and flame resistance and retention of mechanical strength, but also a satisfactory moisture absorption, anti-pilling property and touch, and thus are useful as a flame-resistance material for various uses.

EXAMPLES

The present invention will be further explained by way of specific examples, which are merely representative and do not restrict the scope of the present invention in any way.

EXAMPLE 1

A poly-m-xylylene isophthalamide was prepared in the following manner.

Isophthalic acid chloride in an amount of 152.5 parts by weight was dissolved in 2500 parts by weight of tetrahydrofuran and the resultant solution was cooled at a temperature of 0° C.

Separately, 102.3 parts by weight of m-xylylene diamine and 111.3 parts by weight of anhydrous sodium carbonate were dissolved in 2500 parts by weight of water, and the resultant aqueous solution was cooled at a temperature of 5° C.

The aqueous solution was mixed with the tetrahydrofuran solution while the mixture was vigorously agitated. Three minutes after the mixing, 2500 parts by weight of water were added to the mixture and the resultant admixture was further agitated for 5 minutes. The resultant polymer was separated by filtration, washed with 2500 parts by weight of water three times, and then dried at a temperature of 100° C. under a reduced pressure.

The resultant poly-m-xylylene isophthalamide had an intrinsic viscosity of 1.0.

A spinning dope solution was prepared by dissolving 20 parts by weight of the poly-m-xylylene isophthalamide and 80 parts by weight of poly-m-phenylene isophthalamide having an intrinsic viscosity of 1.8 in N-methyl2-pyrrolidone. The dope solution had a total concentration of the polymers of 20% by weight.

The dope solution was admixed with 2%, based on the total weight of the polymers, of a brown organic dye (CI Vat Brown 3). The colored dope solution was extruded, at a spinning rate of 4.0 m/min through a spinneret having 10,000 orifices having a diameter of 0.08 mm, into an aqueous coagulating bath containing mainly calcium chloride The coagulated m-aramide polymer filaments were washed with water, drawn at a draw ratio of 2.30 in boiling water, further drawn at a draw ratio of 1.82 on a heating plate at a temperature of 320° C., crimped and then cut.

The resultant m-aramide polymer staple fibers had a denier of 1.5, a length of 51 mm, a crimp number of 11 crimps/25.4 mm, a tensile strength of 3.6 g/denier, an ultimate elongation of 40%, a thermal shrinkage of 9% at a temperature of 300° C., a thermal shrinkage stress of 35 mg/denier at a temperature of 350° C., and a flame resistance of 3.4 seconds.

The m-aramide polymer staple fiber in an amount of 95% by weight was blended with 5% by weight of p-aramide copolymer (copoly-p-phenylene/3,4,-oxydiphenylene terephthalamide) staple fibers, which were available under a trademark of Technola made of Teijin Ltd., and had a denier of 1.5, a length of 51 mm, a crimp number of 10 crimps/25.4 mm, a tensile strength of 25 g/denier and a higher flame resistance than that of the m-aramide polymer staple fibers, by a conventional method. The staple fiber blend was spun and twisted to provide spun yarns having a yarn count of 30 S/2.

The spun yarns were converted to a plain weave fabric having the following structure.

$$\frac{30\ S/2 \times 30\ S/2}{55\ \text{warps}/25.4\ \text{mm} \times 54\ \text{wefts}/25.4\ \text{mm}}$$

The fabric was scoured and finished by a conventional method. The finished fabric had a weight of 183 g/cm$^2$.

The fabric was subjected to the flame perforation test, and the flame perforation time was 52 seconds and cracks were formed in the fabric.

COMPARATIVE EXAMPLE 1

A comparative fabric was prepared from the m-aramide polymer staple fibers as mentioned in Example 1 in the same manner as in Example 1. As a result of the flame perforation test, the flame perforation time was 3 seconds and a large perforation was formed in the fabric.

EXAMPLE 2

A solution was prepared by dissolving 10.995 g of mixed toluylene diamines consisting of 80% of weight of 2,4-diaminotoluene and 20% by weight of 2,6-diaminotoluene in 150 ml of tetrahydrofuran. The solution was gradually added dropwise to a solution, which was prepared by dissolving 18.253 g of terephthalic acid chloride in 150 ml of tetrahydrofuran, and cooled at a temperature of 0° C.

The resultant slurry was added to an aqueous solution prepared by dissolving 13.4 g of anhydrous sodium carbonate in 300 ml of water, and cooling at a temperature of 0° C. while the mixture was vigorously stirred. Three minutes after the mixing, 300 ml of water was added to the mixture and the resultant admixture was stirred for a further 5 minutes. The resultant polymer was collected by filtration, and washed with about 500 ml of water. The filtration followed by the washing was repeated three times, and the washed polymer was then dried at a temperature of 100° C. under a reduced pressure.

The resultant m-aramide copolymer had an intrinsic viscosity of 1.45.

A spinning dope solution was prepared by dissolving 22.0 g of the m-aramide copolymer and 124.7 g of poly-m-phenylene isophthalamide having an intrinsic viscosity of 1.80 in 552.0 g of N-methyl-2-pyrrolidone. The dope solution was extruded through a spinneret with 100 orifices having a diameter of 0.08 mm at a spinning speed of 4.0 m/min and the resultant streams of the dope solution were introduced into and coagulated in an aqueous coagulating bath mainly containing calcium chloride.

The coagulated filaments were washed with water, drawn in boiling water at a draw ratio of 2.30, further drawn on a heating plate at a temperature of 340° C. at a draw ratio of 1.82 and then wound by a winder, to provide a m-aramide polymer filament yarn.

A tow prepared by bundling 100 threads of the filament yarns and having a denier of 200,000, was crimped and cut.

The resultant m-aramide polymer staple fibers had a denier of 2.0, a length of 51 mm, a crimp number of 11 crimps/25.4 mm, a tensile strength of 4.3 g/denier, an ultimate elongation of 47%, a thermal shrinkage of 13.5% at 300° C., a thermal shrinkage stress of 45 mg/denier at 350° C., and a flame resistance of 3.1 seconds.

A staple fiber blended was prepared from 95% by weight of the m-aramide polymer staple fibers and 5% by weight of the same p-aramide copolymer staple fibers (Technola) as mentioned in Example 1, by a conventional method, and converted to a plain weave fabric having the structure of $$\frac{30\ S/2 \times 30\ S/2}{55\ \text{warps}/25.4\ \text{mm} \times 54\ \text{wefts}/25.4\ \text{mm}}$$

by conventional blend spinning, twisting and weaving methods.

After usual scouring and finishing operations, the resultant fabric had a weight of 180 g/m$^2$. As a result of the flame perforation test, cracks were formed in the fabric and the flame perforation time was 40 seconds.

EXAMPLE 3

A solution of 17.8 g of 4-chloro-m-phenylene diamine in 125 ml of tetrahydrofuran was gradually added dropwise and mixed in a solution prepared by dissolving 25.4 g of isophthalic acid chloride in 125 ml of tetrahydrofuran and cooling at a temperature of 0° C., while the mixture was stirred.

The resultant slurry was added to an aqueous solution prepared by dissolving 21.2 g of anhydrous sodium carbonate in 250 ml of water and cooling at a temperature of 3° C., while vigorously stirring the mixture. Three minutes after the addition, about 300 ml of water was added to the mixture and the resultant mixture was stirred for a further 5 minutes.

The resultant polymer was collected by filtration, washed with about 500 ml of water three times, and dried at a temperature of 100° C. under a reduced pressure. The resultant m-aramide polymer exhibited an intrinsic viscosity of 0.24.

A spinning dope solution was prepared by dissolving 4.0 g of the above-mentioned polymer and 20.0 g of poly-m-phenylene isophthalamide having an intrinsic viscosity of 1.80 in 80 ml of N-methyl-2-pyrrolidone. The dope solution was extruded at a spinning speed of 4.0 m/min through a spinneret with 200 orifices having a diameter of 0.08 mm, and the extruded filamentary streams of the dope solution were introduced into and coagulated in an aqueous coagulating bath containing mainly calcium chloride. The resultant filaments were washed with water, drawn in boiling water at a draw ratio of 2.30, and further drawn on a heating plate at a temperature of 350° C. and a draw ratio of 1.80, and the drawn filaments then wound by a winder, to provide a m-aramide polymer filament yarn.

A filament tow prepared by bundling 100 threads of the filament yarn and having a denier of 30,000 was crimped and cut by the usual method.

The resultant m-aramide polymer staple fibers had a denier of 1.5, a length of 51 mm, a crimp number of 11 crimps/25.4 mm, a tensile strength of 4.1 g/denier, an ultimate elongation of 53%, a thermal shrinkage of 7.5% at a temperature of 300° C., a thermal shrinkage stress of 40 mg/denier at a temperature of 350° C., and a flame resistance of 3.5 seconds.

A blend of 90% by weight of the above-mentioned m-aramide polymer staple fibers with 10% by weight of the same p-aramide copolymer staple fibers (Technola) as mentioned in Example 1 was spun, and the resultant spun yarns were double-twisted and converted to a plain weave fabric having the following structure.

$$\frac{30\ S/2 \times 30\ S/2}{55\ \text{warps}/25.4\ \text{mm} \times 54\ \text{wefts}/25.4\ \text{mm}}$$

The fabric was scoured and finished in a usual manner. The finished fabric had a weight of 185 g/m$^2$.

In the flame perforation test applied to the fabric, it was found that cracks were formed in the fabric and the flame perforation time was 52 seconds.

EXAMPLE 4

The same fabric as mentioned in Example 1 was relaxed by circulating in hot water at a temperature of 130° C. under pressure for 30 minutes. The relaxed fabric had a weight of 197 g/m$^2$.

In the flame perforating test, the resultant flame perforating time was 71 seconds.

Example 5 and Comparative Examples 2 and 3

In each of Example 5 and Comparative Examples 2 and 3, a spinning dope solution was prepared by dissolving 20 parts by weight of a poly-m-phenylene isophthalamide prepared by polymerizing m-phenylene diamine with isophthalic acid chloride and having an intrinsic viscosity of 1.8, in 80 parts by weight of N,N-dimethyl acetamide and by removing bubbles from the solution at a temperature of 50° C. The dope solution was free from bubbles.

The dope solution was extruded at a spinning speed of 8 m/min through a spinneret with 7000 orifices having a diameter of 0.12 mm, and the extruded filamentary streams of the dope solution were coagulated in an aqueous coagulating bath.

The resultant filaments were washed with water, drawn in boiling water and then on a heating plate at a temperature of 360° C. and the total draw ratio indicated in Table, crimped by a stuffing box type crimper, and cut to a length of 51 mm by a cutter. The resultant m-aramide polymer staple fibers had the tensile strength, ultimate elongation, thermal shrinkage at a temperature of 300° C., thermal shrinkage stress at a temperature of 350° C. and flame resistance indicated in Table 1.

TABLE 1

| | Example No. | | |
|---|---|---|---|
| | Example | Comparative Example | |
| Item | 5 | 2 | 3 |
| Total draw ratio | 3.2 | 4.0 | 4.4 |
| Tensile strength (g/d) | 3.6 | 5.1 | 5.5 |
| Ultimate elongation (%) | 50 | 36 | 32 |
| Thermal shrinkage at 300° C. (%) | 11 | 6 | 5 |
| Thermal shrinkage stress at 350° C. (mg/d) | 70 | 160 | 200 |
| Flame resistance (sec) | 3.9 | 4.0 | 4.0 |

A staple fiber blend was prepared from 95% by weight of the above-mentioned m-aramide polymer staple fibers and 5% by weight of the same p-aramide copolymer staple fibers (Technola) as mentioned in Example 1, and converted to a plain weave fabric having the following structure.

$$\frac{30\ S/2 \times 30\ S/2}{55\ \text{warps}/25.4\ \text{mm} \times 54\ \text{wefts}/25.4\ \text{mm}}$$

The flame perforation time of the fabric is shown in Table 2.

TABLE 2

| | Example No. | | |
|---|---|---|---|
| | Example | Comparative Example | |
| Item | 5 | 2 | 3 |
| Flame perforation time (sec) | 45 | 5* | 5* |

Note: *In comparative Examples 2 and 3, small holes were formed in the fabrics.

COMPARATIVE EXAMPLE 4

A comparative plain weave fabric was produced from the same m-aramide polymer staple fibers as mentioned in Comparative Example 3. The structure of the fabric was the same as mentioned in Comparative Example 3.

In the flame perforation test, the flame perforation time of the comparative fabric was 3 seconds and a large perforation was formed.

EXAMPLES 6 TO 9 AND COMPARATIVE 5

In each of Examples 6 to 9 and Comparative Example 5, the same procedures for producing m-aramide polymer staple fibers as those described in Example 1 were carried out except that 100 parts by weight of poly-m-phenylene isophthalamide were mixed with 4 parts by weight of an organic blue pigment (C1 Vat Blue 4) and 5 parts by weight of a flame-retarding agent consisting of tris (2,4-dichlorophenyl) phosphate.

The resultant m-aramide polymer staple fibers had a denier of 2, a length of 51 mm, a crimp number of 11 crimps/25.4 mm, a tensile strength of 5.0 g/denier, and ultimate elongation of 38%, a thermal shrinkage of 6% at a temperature of 300° C., a thermal shrinkage stress of 100 mg/denier at a temperature of 350° C., a LO1 value of 39, and a flame resistance of 3.8 seconds. The m-aramide polymer staple fibers were blended with the same p-aramide copolymer staple fibers (Technola) as mentioned in Example 1, in the proportion shown in Table 3.

The staple fiber blend was converted to a plain weave fabric having the same structure as mentioned in Example 1, in the same manner as mentioned in Example 1.

The fabric exhibited the flame perforation time as shown in Table 3.

TABLE 3

| | Example No. | | | | |
|---|---|---|---|---|---|
| | Example | | | | Comparatime Example |
| Item | 6 | 7 | 8 | 9 | 5 |
| Blend proportion (% wt) | | | | | |
| m-aramide polymer staple fibers | 95 | 90 | 85 | 80 | 70 |
| p-aramide copolymer staple fibers | 5 | 10 | 15 | 20 | 30 |

TABLE 3-continued

| Item | Example No. | | | | |
|---|---|---|---|---|---|
| | Example | | | | Comparatime Example |
| | 6 | 7 | 8 | 9 | 5 |
| Flame perforation time (sec) | 55 | 58 | 57 | 52 | 52 |
| Touch | Soft | Soft | Soft | Soft | Soft |
| Luster | Even | Even | Even | Even | Uneven |
| General evaluation | Satisfactory | Satisfactory | Satisfactory | Satisfactory | Unsatisfactory |

EXAMPLE 10

The same drawn m-aramide polymer filaments as mentioned in Example 1 were subjected to a heatshrinking treatment at a shrinkage of 5% on a heating plate at a temperature of 350°, and then crimped and bias cut.

The resultant m-aramide polymer staple fibers had a denier of 2, a length of from 76 to 102 mm, a tensile strength of 4.9 g/denier, an ultimate elongation of 46%, a thermal shrinkage of 3% at a temperature of 300° C., a thermal shrinkage stress of 30 mg/denier at a temperature of 350° C., and a flame resistance of 3.4 seconds.

A fiber blend was prepared from 50% by weight of the above-mentioned m-aramide polymer staple fibers, 5% by weight of the same p-aramide copolymer staple fibers (Technola) as mentioned in Example 1, except for a denier of 2 and a length of 76 mm, and 45% by weight of merino wool fibers having an average thickness of 21 μm and a length of 60 to 130 mm, in a usual manner. The merino wool fibers were non-fusible.

The fiber blend was spun and woven to form a 2/2 twill fabric having the following structure.

$$\frac{2/52 \times 2/52}{97 \text{ warps}/25.4 \text{ mm} \times 61 \text{ wefts}/25.4 \text{ mm}}$$

The fabric was scoured in a usual manner, a flame retarding treatment for the wool fibers was applied to the fabric, and the fabric then finished.

The fabric had a weight of 265 g/m$^2$ and exhibited a flame perforation time of 35 seconds.

COMPARATIVE EXAMPLE 6

A wool fabric having a weight of 334 g/m$^2$ was treated with a flame-retarding agent available under a trademark of Zapro. The flame retarded wool fabric exhibited a flame perforation time of 4 seconds.

EXAMPLES 11 TO 13 AND COMPARATIVE EXAMPLES 7 TO 9

In each of Examples 11 to 13 and Comparative Examples 7 to 9 a fiber blend was provided from the same m-aramide polymer staple fibers as in Example 5, the same p-aramide copolymer staple fibers (Technola) as in Example 1, and flame retarded viscose rayon staple fibers (trademark: Tafvan, made by Toyobo Co.) having a denier of 1.4, a length of 44 mm, and a crimp number of 5 to 12/25.4 mm, in the blending proportion as indicated in Table 4. The flame-retarded viscose rayon fibers were non-fusible.

The fiber blend was spun and woven as indicated in Table 4 in a usual manner, the rayon fibers in the resultant fabric were dyed, and the fabric was finished in a usual manner.

The resultant fabric exhibited the flame perforation time as shown in Table 4.

TABLE 4

| Item | | Example No. | | | | | |
|---|---|---|---|---|---|---|---|
| | | Example (*)$_1$ | | | Comparative Example | | |
| | | 11 | 12 | 13 | 7 | 8 | 9 |
| Blend proportion (% wt) | m-aramide polymer staple fibers | 60 | 60 | 35 | 0 | 65(*)$_2$ | 65(*)$_3$ |
| | p-aramide copolymer staple fibers | 3 | 3 | 5 | 0 | 0 | 0 |
| | Viscose rayon staple fibers | 37 | 37 | 60 | 100 | 35 | 35 |
| Fabric | Type of structure | Plain Weave 30 S/2 × 30 S/2 | | 2/1 Twill 30 S/2 × 30 S/2 | | Plain Weave 30 S/2 × 30 S/2 | |
| | | 55/25.4 mm × 54/25.4 mm | | 89/25.4 mm × 54/25.4 mm | | 55/25.4 mm × 54/25.4 mm | |
| | Weight (g/m$^2$) | 197 | 209 | 265 | 265 | 190 | 192 |
| Flame perforation time (sec) | | 28 | 35 | 35 | 3 | 9 | 2 |

Note:
(*)$_1$ The fabrics of Examples 11 to 13 were relaxed by circulating in hot water at a temperature of 120° C. for 30 minutes.
(*)$_2$ The m-aramide polymer staple fibers in Comparative Example 8 were the same as in Example 5.
(*)$_3$ The m-aramide polymer staple fibers in Comparative Example 9 were the same as in Comparative Example 3.

EXAMPLE 14

A colored dope solution was provided by mixing a solution of 20% by weight of a poly-m-phenylene isophthalamide having an intrinsic viscosity of 1.8 in N-methyl-2-pyrrolidone with 2%, based on the weight of the above-mentioned polymer, of an organic red pigment (C.I. Pigment Red 44), and 5%, based on the weight of the polymer, of an ultraviolet ray-absorbing agent consisting of 2-(2'-hydroxy-3,-test-butyl-5'-methyl)5-chlorobenzotriazol.

The dope solution was converted to m-aramide polymer staple fibers in the same manner as in Example 1. The resultant m-aramide polymer staple fibers had a denier of 1.5, a length of 51 mm, a crimp number of 11 crimp/25.4 mm, a tensile strength of 4.8 g/denier, an ultimate elongation of 38%, a thermal shrinkage of 6% at a temperature of 300° C., a thermal shrinkage stress of 120 mg/denier at a temperature of 350° C., and a flame resistance of 3.8 seconds.

A staple fiber blend was prepared from 50% by weight of the above-mentioned m-aramide polymer staple fibers, 5% by weight of the same p-aramide copolymer staple fibers (Technola) as in Example 1, and 45% by weight of American cotton fibers having a denier of 1.9 to 3.0 and a length of 20 to 30 mm. The American cotton fibers were non-fusible.

Then the fiber blend was spun and woven to provide a plain weave fabric having the same structure as mentioned in Example 1.

The fabric was scoured and the cotton fibers in the fabric were dyed and flame-retarded in a usual manner. The resultant fabric had a weight of 200 g/m$^2$ and exhibited a flame perforation time of 29 seconds.

COMPARATIVE EXAMPLE 10

A comparative cotton fabric treated by a flameretarding agent (available under a trademark of Provan) and having a weight of 287 g/m$^2$, exhibited a flame perforation time of 14 seconds.

All of the fabrics of Examples 1 to 10 and Comparative Examples 1 to 10 passed the flame retarding tests of JIS L1091, A-1 method and A-4 method.

We claim:

1. A flame resistant staple blend comprising:

(A) 80 to 97 parts by weight of staple fibers comprising a m-aramide polymer material consisting of a mixture of a poly-m-phenyleneisophthalamide polymer with at least one additional aramide polymer comprising an acid component consisting of an aromatic dicarboxylic acid and an amine component consisting of 35 to 100 molar % of xylylene diamine and 0 to 65 molar % of an aromatic diamine different from the xylene diamine, and having a thermal shrinkage stress of 130 mg/denier or less at a temperature of about 350° C.; and (B) 3 to 20 parts by weight of staple fibers comprising a p-aramide copolymer comprising two types of recurring units of the formulae:

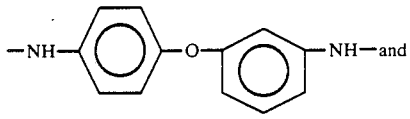

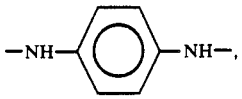

and recurring units of the formula:

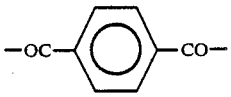

having a higher flame resistance than that of the m-aramide staple fibers (A), and evenly blended with the m-aramide staple fibers (A).

2. The fiber blend as claimed in claim 1, wherein the p-aramide copolymer is a copoly-p-phenylene/3,4'-oxydiphenylene terephthalamide.

3. The fiber blend as claimed in claim 1, which comprises (C) 240 parts by weight or less of additional staple fibers, which are not fusible, evenly blended with the staple fibers (A) and (B).

4. The fiber blend as claimed in claim 3, wherein the additional staple fibers (C) are in an amount of 25 to 125 parts by weight.

5. The fiber blend as claimed in claim 3, wherein the additional staple fibers (C) are selected from frame-retarded cotton fibers, wool fibers and regenerated cellulose fibers.

* * * * *